US005799097A

United States Patent [19]

Lo

[11] Patent Number: 5,799,097

[45] Date of Patent: Aug. 25, 1998

[54] EARPHONE RADIO RECEIVER

[75] Inventor: Jung-Chao Lo, Yung Kang, Taiwan

[73] Assignee: Jui Chu Enterprise Co., Ltd., Tainan Hsien, Taiwan

[21] Appl. No.: 977,393

[22] Filed: Nov. 24, 1997

[51] Int. Cl.[6] ..... H04R 25/00

[52] U.S. Cl. ..... 381/187; 381/183; 455/351

[58] Field of Search ..... 381/25, 68.6, 183, 381/187; 379/430; 181/128, 129, 135; 455/351, 344, 347, 350

[56] References Cited

U.S. PATENT DOCUMENTS 3,826,987 7/1974 Stevens ..... 455/351

*Primary Examiner*—Huyen Le

*Attorney, Agent, or Firm*—Rosenberg, Klein & Bilker

[57] ABSTRACT

An ear-phone radio receiver includes a first half housing and a second half housing both shaped as L and combined together to contain an ear-phone, a circuit board with a radio receiver set arranged on its surface, a tuning disk disposed at an outer side of the both half housings, a battery and an antenna. The ear-phone is directly connected with the radio receiver, protruding out of the housings to be inserted in an ear for a person to listen to a radio program by turning on and off a switch protruding out of the housings and tuned in by rotating the tuning disk.

1 Claim, 4 Drawing Sheets

EARPHONE RADIO RECEIVER

BACKGROUND OF THE INVENTION

This invention relates to an ear-phone radio receiver, particularly one having a very light weight to be inserted in an ear of a person for listening.

Radio receivers have been widely used for listening to news, music, etc., and especially small radio receivers are popular, having an ear-phone connected with a receiver set with wires, with the ear-phone inserted in an ear (or ears) and with the receiver set put in a pocket or hung on a belt. However, in practical use, these kinds of conventional ear-phone radio receivers have the disadvantages as follows.

1. The wires connecting the ear-phone and the receiver set often entangle with other things, very inconvenient to use.

2. connecting points of the wires with the ear-phone and the receiver set are liable to wear off, becoming useless.

3. If the receiver set and the ear-phone are hung on a head of a person, they may fall down in case of lowering his/her head.

4. If the radio receiver and the ear-phone are hung on the head of a person for a long time, the person may feel uncomfortable.

SUMMARY OF THE INVENTION

The purpose of the invention is to offer a kind of ear-phone radio receiver, able to be inserted in an ear of a person, having a very light weight not to cause uncomfortableness to the user.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
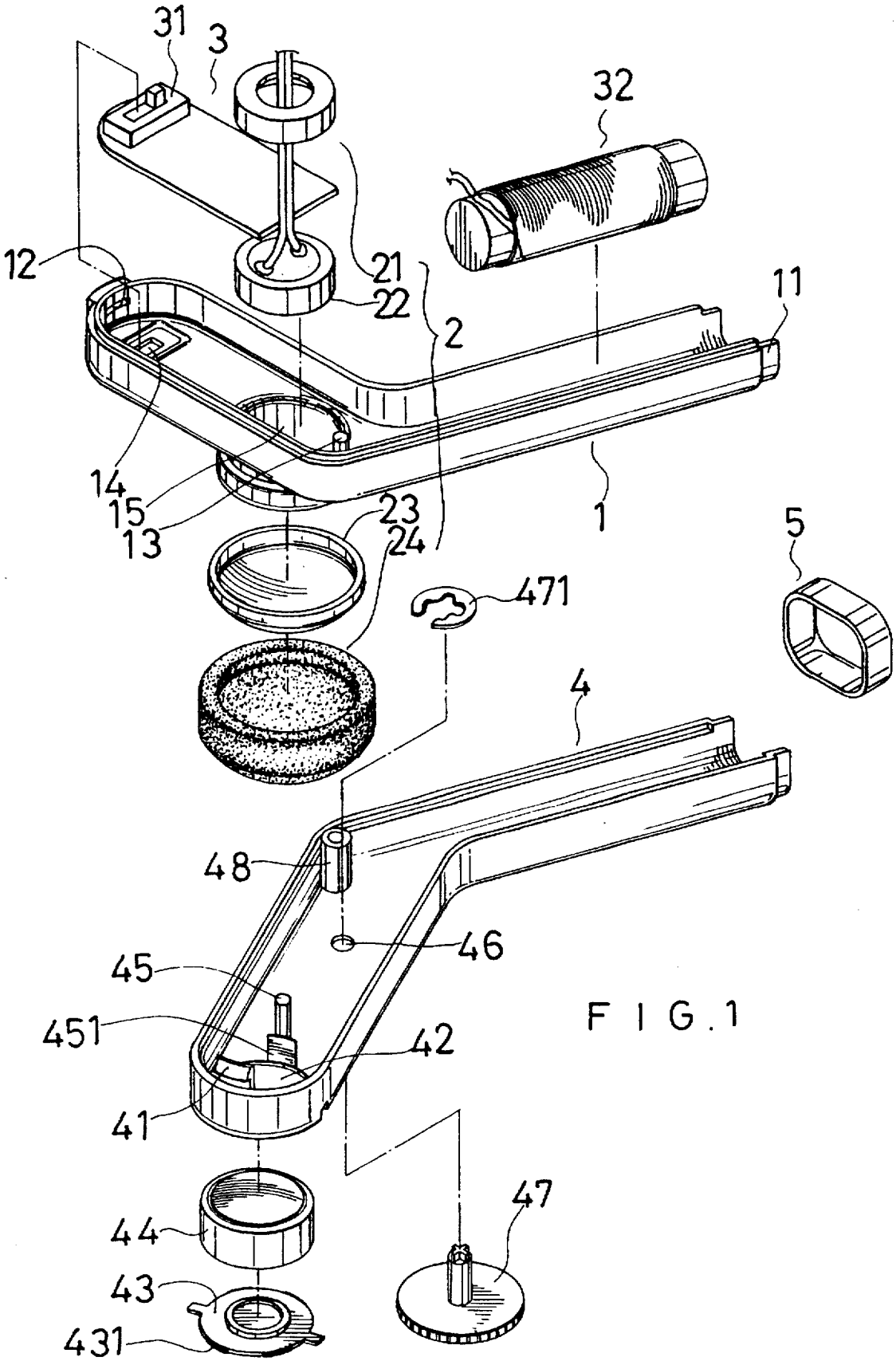
FIG. 1 is an exploded perspective view of an ear-phone radio receiver in the present invention.

A preferred embodiment of an ear-phone radio receiver in the present invention, as shown in FIG. 1, includes a first half housing 1, an ear-phone 2, a circuit board 3 and a second half housing 4 as main components.

The first half housing 1 is L-shaped, having an open upper side and an open rear end provided with a projecting edge 11 of a very short length, an engage means 12 formed on an inner wall of a front end, a vertical rid 13 standing on a bottom near an intermediate bending corner, a switch hole 14 in the bottom near the front end, and an annular ear-phone base 15 fixed in an intermediate portion of the bottom.

The ear-phone 2 consists of a position ring 21 fixed in the annular ear-phone base 15 of the first half housing 1, a speaker 22 fitted in the position ring 21, an ear-phone cap 23 closing on a lower end of the annular ear-phone base 15, and a soft sponge cover 24 covering on the cap 23.

The circuit board 3 contains a necessary electric components for receiving radio frequency and a power supplier, a power switch 31 fixed at a front end, and an antenna 32 connected with a rear end.

The second half housing 4 is shaped to correspond to that of the body 1, having a position hook 41 at a front end corresponding to the engage means 12 of the first half housing 1, a round hole 42 near the position hook 41 for a battery 44 to fit through, a lid 43 covering on the round hole 42 and having plural projections 431 on an outer edge to tightly engage with the round hole 42, and the battery 44 placed inside the lid 43 and fitting through the round hole 42. The second half housing 4 further has a position rod 45 standing on the bottom near the hole 42, and a small chip 451 fixed at a lower portion of the position rod 45 for securing the battery 44, and a hole 46 in an intermediate portion for the tuning disc 47 to protrude and then secured by a C-shaped lock washer 471, and an engage sleeve 48 near the hole 46 to engage the rod 13 of the body 1.

Figure 2:
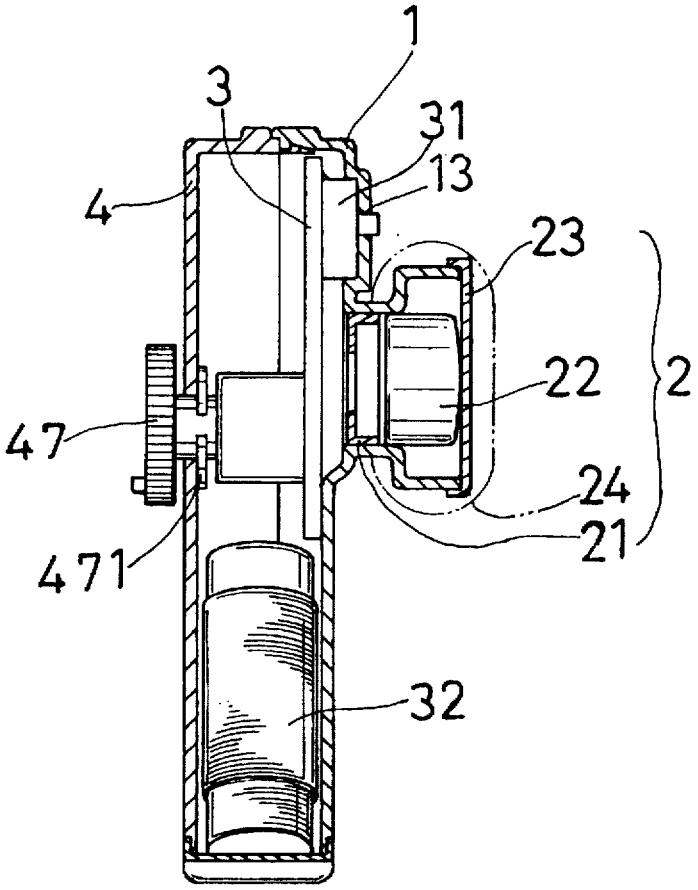
FIG. 2 is a side cross-sectional view of the ear-phone radio receiver in the present invention.
Figure 3:
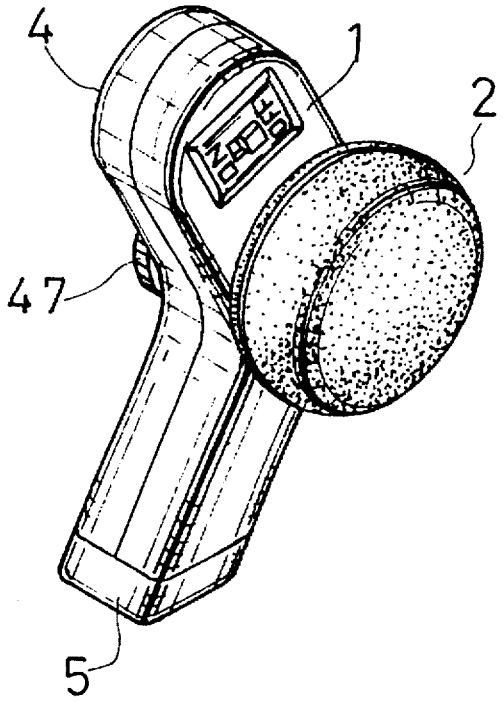
FIG. 3 is a perspective view of the ear-phone radio receiver in the present invention.

In assembling, referring to FIGS. 2 and 3, firstly, the ear-phone 2 and the circuit board 3 are combined with the first half housing 1, with the power switch 31 fitting in the switch hole 14 and securing the circuit board 3 in place, with the antenna 32 connected with the rear end. Then the second half housing 4 is combined with the first half housing 1, with the tuning disc 47 fitting through the hole 46 and secured by the position hook 41 engaging the engage means 12 and the engage sleeve 48 engaging the rod 13, with the position rod 45 pressing the circuit board 3 in its place securely. Then the fix cap 5 is fixed with the rear ends of both the first half housing 1 and the second half housing 4. After that, the battery 44 is placed through the hole 42 and secured by the chip 451 in the space formed by the body of the first half housing 1 and the second half housing 4, and covered with the lid 43, finishing assemblage of this ear-phone radio receiver.

Figure 4:
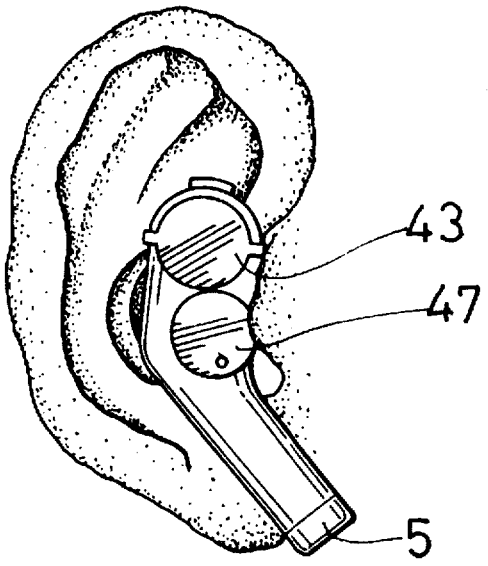
FIG. 4 is a perspective view of the ear-phone radio receiver being in use, fitted in an ear; and, FIG. 5 is a side view of the ear-phone fitted in an ear.
Figure 5:
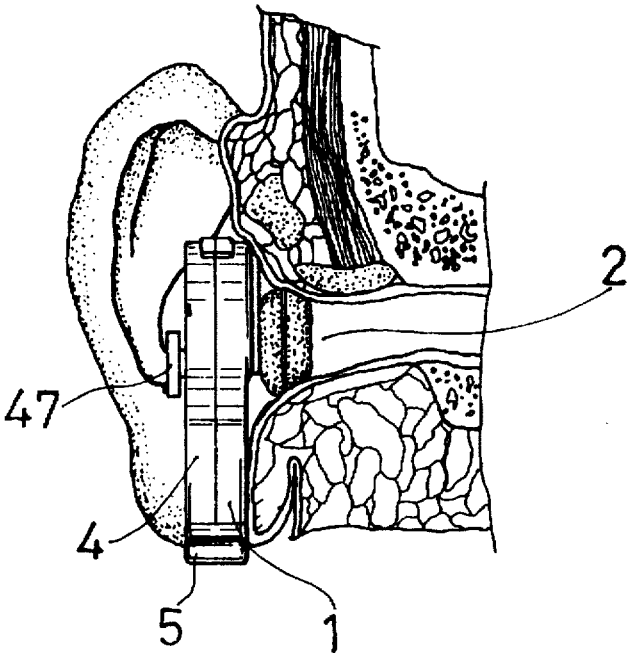

In using, referring to FIGS. 4 and 5, the ear-phone 2 is inserted in an ear, and the tuning disc 47 is rotated to find a radio station for listening to a needed program.

This ear-phone radio receiver has following advantages, as can be understood from the aforesaid description.

1. There never arises bad connection of the wires of the ear-phone with the receiver itself, as the ear-phone and the receiver are combined together without wires like conventional receivers with an ear-phone.

2. Wire entangling never occurs, as no wires are used between the ear-phone and the receiver.

3. it can be carried or stored away with easiness, whether on a travel or at home.

4. Its weight is very light, easy to carry.

5. It has a modern configuration, enhancing competitiveness.

While the preferred embodiment of the invention has been described above, it will be recognized and understood that various modifications may be made therein and the appended claims are intended to cover all such modifications which may fall within the spirit and scope of the invention.

What is claimed is:

1. An ear-phone radio receiver comprising:

a first half housing nearly L-shaped having an upper open side and an open rear side, an engage means fixed on an inner side of a front end, a rod standing on a bottom near a bent corner, a switch hole in the bottom near the front end, and an annular ear-phone base fixed in the bottom;

an ear-phone consisting of a speaker disposed in said ear-phone base of said first half housing, and a position cap closed on an upper side of said ear-phone base;

a second half housing of the same shape as that of said first half housing, having a round hole in a bottom near a front end, a position hook fixed on an inner surface of the front end, a lid covering on said position hole, a vertical position rod standing on the bottom near said round hole, and a hole in an intermediate portion of the bottom for a tuning disc to pass through and a vertical engage sleeve standing on the bottom near a bent corner to fit with said rod of said first half housing;

a fix cap of a proper size closing up open rear ends of both said first half housing and said second half housing after both said half housings are combined together; and, a circuit board having a necessary radio receiving set arranged on its surface, combined with said ear-phone, said second half housing together with said tuning disk combined with said first half housing, with said position hook of said second half housing engaging said engage means of said first half housing with said engage sleeve of said second half housing engaging said rod of said first half housing, with said position rod of said second half housing pressing securely said circuit board, said fix cap closed on the rear ends of said first half housing and said second half housing after both said half housings are combined together, said battery placed through said hole of said second half housing into a space formed by both said half housings, said lid of said second half housing closed on said hole and securing said battery in its place, said ear-phone able to be inserted in an ear of a person, said circuit board having a power switch adapted for operation to turn on and off the receiver, and said tuning disc rotated to tune in a radio frequency.

* * * * *